US005080265A

United States Patent [19]

Hintzen et al.

[11] Patent Number: 5,080,265

[45] Date of Patent: Jan. 14, 1992

[54] APPARATUS FOR CLOSING AND/OR REGULATING THE TAPPING OF MOLTEN METAL

[75] Inventors: Ullrich Hintzen, Taunusstein-Watzhahn; Ernst Lührsen, Bad Schwalbach; Andreas Schuler, Taunusstein, all of Fed. Rep. of Germany

[73] Assignee: Didier-Werke AG, Wiesbaden, Fed. Rep. of Germany

[21] Appl. No.: 597,661

[22] Filed: Oct. 17, 1990

[30] Foreign Application Priority Data

Oct. 17, 1989 [DE] Fed. Rep. of Germany ..... 3934602

[51] Int. Cl.[5] ..... B22D 41/16

[52] U.S. Cl. ..... 222/598; 222/602; 222/591

[58] Field of Search ..... 222/591, 598, 599, 602

[56] References Cited

U.S. PATENT DOCUMENTS 3,651,998 3/1972 Rocher ..... 222/598
4,949,886 8/1990 Lührsen et al. ..... 222/598
4,966,314 10/1990 Brückner et al. ..... 222/598

FOREIGN PATENT DOCUMENTS

3540202C1 11/1985 Fed. Rep. of Germany .
3731600A1 9/1987 Fed. Rep. of Germany .

*Primary Examiner*—S. Kastler
*Attorney, Agent, or Firm*—Wenderoth, Lind & Ponack

[57] ABSTRACT

A closing and/or regulating apparatus for tapping molten metal from the interior or a metallurgical vessel includes a vertical inner pipe having extending through a wall thereof at least one opening for the passage of molten metal. An outer pipe is fitted over the inner pipe and has extending through a wall thereof at least one opening. One of the pipes is to be mounted stationarily with respect to a metallurgical vessel, and the other of the pipes is displaceable relative to such one pipe in a vertical axial direction through a working stroke at which the openings of the pipes may be brought into alignment to thereby discharge molten metal downwardly through the interior of the inner pipe. The dimension of the opening in the stationary pipe in such direction is greater than the dimension of the opening in the displaceable pipe in such direction. The circumferential dimension of the opening in the displaceable pipe is substantially the same as the circumferential dimension of a lower portion of the opening in the stationary pipe.

27 Claims, 2 Drawing Sheets

APPARATUS FOR CLOSING AND/OR REGULATING THE TAPPING OF MOLTEN METAL

BACKGROUND OF THE INVENTION

The present invention relates to an apparatus for closing and/or regulating the tapping of molten metal from the interior of a metallurgical vessel. More particularly, the apparatus includes a vertical inner refractory fireproof pipe which has therethrough, at a level above the bottom of the metallurgical vessel, at least one lateral opening for the passage of molten metal. An outer refractory fireproof pipe is fitted over the inner pipe and has extending through the wall thereof at least one lateral opening for the passage of the molten metal. One of the pipes is to be mounted stationarily in the bottom of the metallurgical vessel to extend vertically upwardly into the interior of the vessel. The other of the pipes is displaceable relative to the stationary pipe in a vertical axial direction through a working stroke within which the openings in the two pipes may be brought into alignment to thereby discharge molten metal downwardly through the interior of the inner pipe.

An apparatus of this general type is disclosed in German DE 35 40 202 Cl wherein an opening of a stationary inner pipe is just as large as an opening in a displaceable outer pipe. During the working stroke the molten metal passes from the vessel bottom into the inner pipe. To control the discharge or tapping of the molten metal, the opening or openings in the outer pipe are brought more or less into alignment with the opening or openings in the inner pipe. Several openings can be provided in order to clean the openings by means of an intensive flow of molten metal.

German DE 37 31 600 Al discloses a rotary nozzle including a stationary outer pipe and an inner pipe that is displaceable in a longitudinal direction. For rapid passage of the molten metal, the stationary outer pipe has an opening the cross section of which is greater than that of its other opening and of the opening in the displaceable inner pipe. To make the opening with the larger cross section effective, the inner pipe is displaced to a position such that its opening no longer has an effect on the molten metal discharge.

In known apparatus of this type, the speed at which the melt is discharged is strongly dependent on the height or level of the bath of molten metal within the vessel, i.e. hydrostatic pressure of the molten metal. Since the discharge height above the bottom of the vessel, and thereby from the upper level of the molten metal, is determined by the height of the opening through the stationary pipe, the speed of discharge of molten metal is higher for a higher bath level than for a lower bath level. This reduction in discharge speed as the bath level lowers results in a reduction in quality of the discharged metal, and particularly a reduction in steel grade when the molten metal is steel.

SUMMARY OF THE INVENTION

With the above discussion in mind, it is an object of the present invention to provide an apparatus for closing and/or regulating the tapping of molten metal from the interior of a metallurgical vessel, but wherein it is possible to overcome the above and other prior art disadvantages.

It is a more particular object of the present invention to provide such an apparatus with which it is possible to control the speed of discharge of the molten metal.

It is yet a further object of the present invention to provide such an apparatus wherein the rate of discharge of the molten metal is regulated by adjustment of the discharge height of the molten metal, i.e. the height at which the molten metal is passed from the interior of the metallurgical vessel into the interior of the inner pipe of the apparatus.

These objects are achieved in accordance with the present invention by the provision that the dimension of the opening or opening means in the stationary pipe in the vertical direction is greater than the dimension of the opening or opening means in the displaceable pipe in such direction. Further, the circumferential dimension of the opening means in the displaceable pipe is substantially the same as the circumferential dimension of a lower portion of the opening means in the stationary pipe. Still further, at an upper end of the working stroke a lower portion of the opening means in the stationary pipe is closed by the displaceable pipe and an upper portion of the opening means in the stationary pipe is aligned with the opening means in the displaceable pipe. Even further, at a lower end of the working stroke the upper portion of the opening means in the stationary pipe is closed by the displaceable pipe and the lower portion of the opening means in the stationary pipe is aligned with the opening means in the displaceable pipe.

By the above features in accordance with the present invention, the discharge height of the melt can be adjusted by raising or lowering the displaceable pipe within the extent or length of the working stroke. In this manner, the rate of discharge of molten metal can be controlled, for example can be maintained relatively constant, or can be adjusted as desired, as a function of the adjustment of the discharge height as the height of the bath level is reduced. In other words, as the height of the bath level is decreased, the discharge height can be varied so that the distance between the bath level and the point of discharge of the molten metal is maintained substantially the same or is varied as desired. Thus, to obtain the same discharge velocity or rate for different bath levels, the discharge height is adjusted in such a manner that the distance between the bath level and the point of discharge remains the same. As a result, the hydrostatic pressure will remain substantially constant. If the discharge velocity of the molten metal is too high, the displaceable pipe may be moved upwardly, thus reducing the discharge velocity. On the contrary, if the discharge velocity is too low, the displaceable pipe may be moved downwardly, thus lowering the position of discharge and increasing the velocity of discharge.

As a result of this capability of adjustment of the discharge velocity and thus of the flow velocity of the molten metal, it is possible to achieve a state in which contaminants within the molten metal have sufficient time to separate at the bath level without being drained through the closing and/or regulating apparatus. Additionally, currents in the vicinity of the vessel bottom can be prevented from entering directly into the closing and/or regulating apparatus. Due to the ability to control the discharge height and thereby the discharge velocity, the quality of the molten metal discharged, for example the grade of steel discharged, is improved. Another advantage of the invention is that, in addition to the known control of the cross section of the passage of the closing and/or regulating apparatus, the discharge height also can be adjusted in the manner described. It is particularly advantageous that, at any height that is set, the molten metal always enters the opening through the displaceable pipe having a cross section less than the total cross section of the opening in the stationary pipe. In this manner, it is possible to achieve an accurate and constant in flow of the melt into and through the closing and/or regulating apparatus. The invention further is advantageous when the bath level is controlled in the customary manner, since toward the end of a pouring sequence the bath level always drops and at the start of a subsequent pouring sequence the bath level rises.

In accordance with one embodiment of the present invention the opening means in the stationary pipe comprises at least two openings spaced in the vertical direction at positions above the vessel bottom. The cross section of the displaceable pipe then is preferably the same and of the same shape as one of such openings in the stationary pipe. It thereby is possible to regulate or set the various discharge heights by increments. The openings in the stationary pipe can have the same cross section, but alternatively can have different cross sections in which case the cross section of the opening means in the displaceable pipe matches the cross section of the larger of the openings in the stationary pipe. Depending upon the particular application involved, the larger of the openings in the stationary pipe can be above or below the smaller opening or openings therein.

In accordance with another embodiment of the present invention, the opening means in the stationary pipe may be a slot that is elongated vertically, i.e. in the direction of the longitudinal axis of the pipes. The slot may have the same circumferential direction at upper and lower portions thereof. Alternatively, the upper portion of the slot may have a circumferential dimension less than that of a lower portion of the slot. The opening means in the displaceable pipe may have a circumferential dimension substantially the same as the circumferential dimension of the lower portion of the slot.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
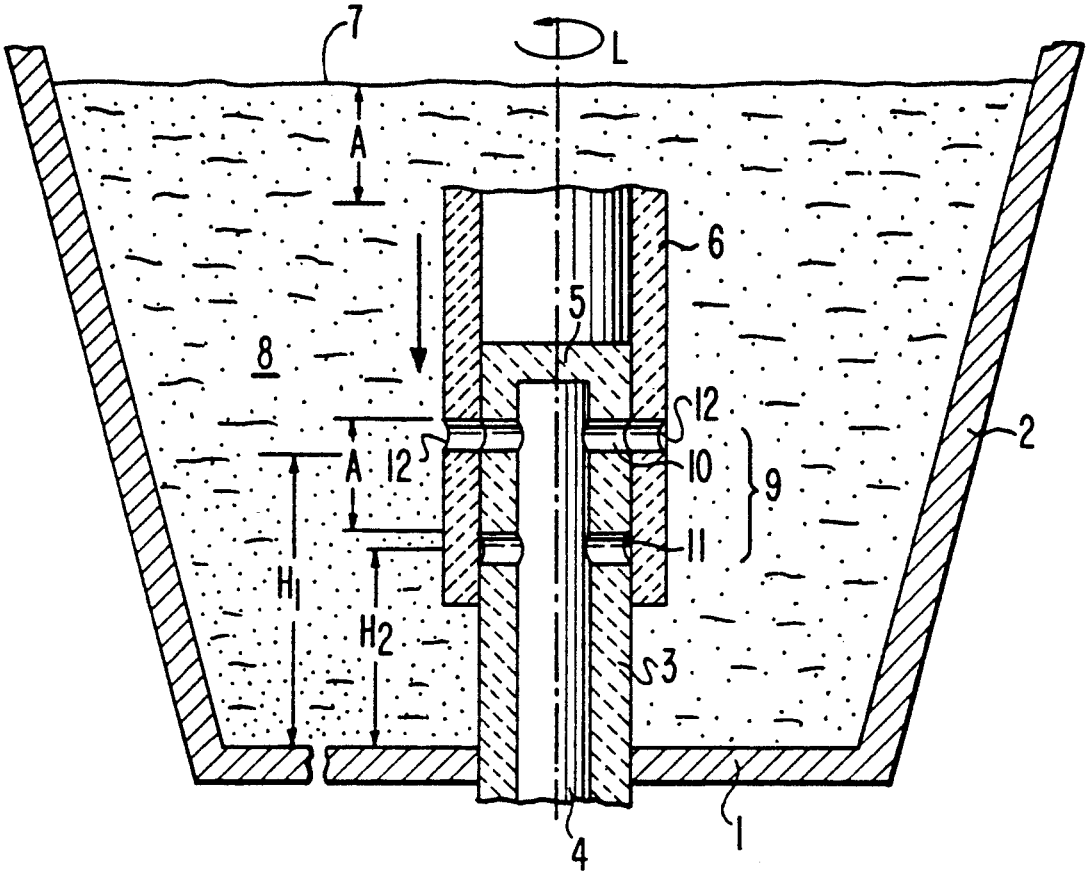
FIG. 1 is a somewhat schematic vertical sectional view through a closing and/or regulating apparatus according to the present invention and illustrated as being mounted in a bottom of a metallurgical vessel.

Illustrated schematically in FIG. 1 is a metallurgical vessel 2 having a bottom 1 and containing therein molten metal 8 having an upper bath level 7.

Mounted in a sealing manner to bottom 1 and extending therethrough is an inner refractory fireproof pipe 3 having therethrough a discharge channel 4 that is open downwardly at a position below bottom 1. Inner pipe 3 is illustrated as being closed at its upper end 5, but such upper end could be open. Pipe 3 extends vertically and has a longitudinal vertical axis L. An outer refractory fireproof pipe 6 fits over inner pipe 3 and is displaceable relative thereto upwardly and downwardly along axis L. Outer pipe 6 also can be rotated about axis L as indicated. Means to achieve such rotation are not illustrated but would be positioned above bath level 7 and could be entirely conventional.

Inner pipe 3 has formed through a wall thereof opening means 9. In the embodiment of FIG. 1 such opening means includes two groups 10, 11 of plural openings. As illustrated, each group 10, 11 includes two diametrically opposite openings. Each group could however include only a single opening or more than two openings. Groups 10, 11 are positioned above bottom 1 and are spaced from each other along axis L. It is to be understood further that more than two groups of openings could be spaced vertically in the direction of axis L.

Outer pipe 6 has therethrough opening means 12 that in the illustrated arrangement is in the form of two diametrically spaced openings through the wall of pipe 6. It is to be understood however that only a single opening 12 or more than two openings 12 could be provided. All of the openings 12 are at the same axial position of pipe 6, and plural openings 12 are spaced circumferentially of pipe 6. In the illustrated embodiment the cross sectional area of each opening 12 is the same as the cross sectional area of each of the openings of groups 10, 11.

The arrangement of FIG. 1 operates in the following manner. Thus, with bath level 7 at a desired level at the beginning of an operation, openings 12 are aligned with the openings of group 10. Thus, at an upper discharge height H1 the molten metal enters channel 4 through openings 12, 10. The precise quantity of molten metal that is discharged can be adjusted slightly by slightly rotating and/or axially moving outer pipe 6 with respect to inner pipe 3. In this manner, the effective cross section of the molten metal passage is changed without having any substantial effect on the discharge height.

If and when the bath level 7 drops by an amount approximately equal to working stroke A, then the hydrostatic pressure will be reduced with the result that the velocity of the molten metal being discharged will be lowered. Outer pipe 6 however can be moved downwardly by the amount of working stroke A, at which position openings 12 will be aligned with openings 11 at a lower discharge height H2. Thereby it will be possible to increase the ferrostatic pressure of the molten metal being discharged and thereby increase the velocity thereof. The above factors readily are controllable and dimensioned to achieve the same velocity of discharge at the two discharge heights. Further, an additional plurality of groups of openings may be provided in stationary pipe 3 to thereby provide a plurality of discharge height positions, at each of which it is possible to define substantially equal discharge velocities or predetermined desired velocities. At each of such positions it is possible to finely adjust the discharge by slight vertical or rotational movement of pipe 6 relative to pipe 3. In view of the above manner of operation it is also possible to prevent slag at the both level from penetrating into channel 4 as the level 7 is lowered and also to prevent the molten metal from being withdrawn directly from bottom 1.

In the above arrangement, when openings 12 are aligned with openings 10, openings 11 are closed by outer pipe 6. Similarly, with openings 12 aligned with openings 11, openings 10 will be closed by pipe 6.

Figure 2:
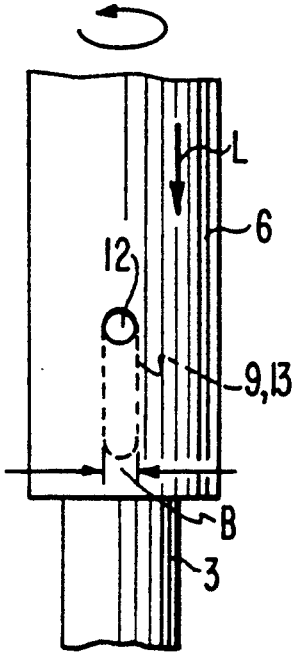
FIG. 2 is a schematic side view of another embodiment of the apparatus of the present invention.

In the embodiment of FIG. 2 the opening means 9 formed in stationary inner pipe 3 is in the form of a vertical slot 13 elongated in a direction parallel to axis or direction L. In the arrangement of FIG. 2 the slot 13 has a substantially uniform width B in the circumferential direction of pipe 3. The circumferential width of opening 12 in displaceable outer pipe 6 is equal to width B of slot 13.

In the arrangement of the embodiment of FIG. 2, as the bath level 7 lowers, outer pipe 6 is moved correspondingly downwardly in a continuous manner. As a result, the discharge height changes continuously within the extent of the working stroke A. Accordingly, the ferrostatic pressure remains substantially the same. In other words, the distance between the bath level 7 and the opening 12 remains approximately constant, such that the velocity of the discharge of the molten metal can be maintained substantially constant or at least at a value that favors a good grade of steel.

Figure 3:
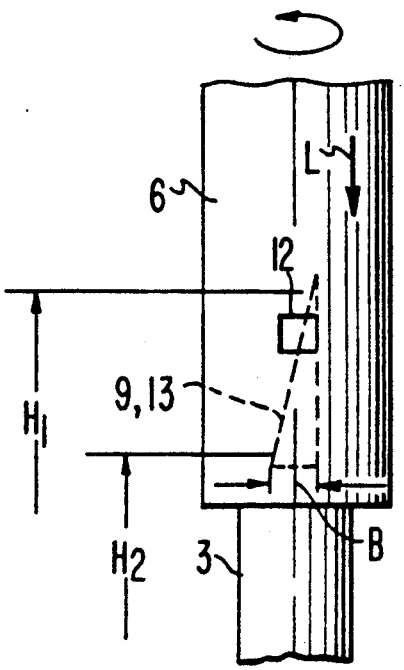
FIG. 3 is a view similar to FIG. 2 of a still further embodiment of the present invention.

In the embodiment of FIG. 3, slot 13 in inner pipe 3 has a circumferential dimension that increases downwardly to a maximum width B. Opening 12 in outer pipe 6 has a circumferential dimension substantially equal to the maximum circumferential width B of slot 13. Thus, opening 12 in outer pipe 6 is wider than the circumferential dimension of slot 13 in the upper portions thereof. As outer pipe 6 is moved downwardly, as a consequence of a lowering bath level 7, not only will the discharge height change from H1 sequentially to H2, but also at the same time the effective cross section of the discharge passage will change, and specifically will gradually increase. In this manner it also is possible to regulate the ferrostatic pressure with lowering of the bath level and lowering of outer pipe 6.

In all of the above embodiments it is guaranteed that it is the cross section of the opening or openings 12 in outer pipe 6 that alone permits the molten metal to pass through the apparatus. To close molten metal discharge channel 4, opening or openings 12 of outer pipe 6 can be adjusted relative to openings 10, 11 or to slots 13 such that the discharge is closed.

Figure 4:
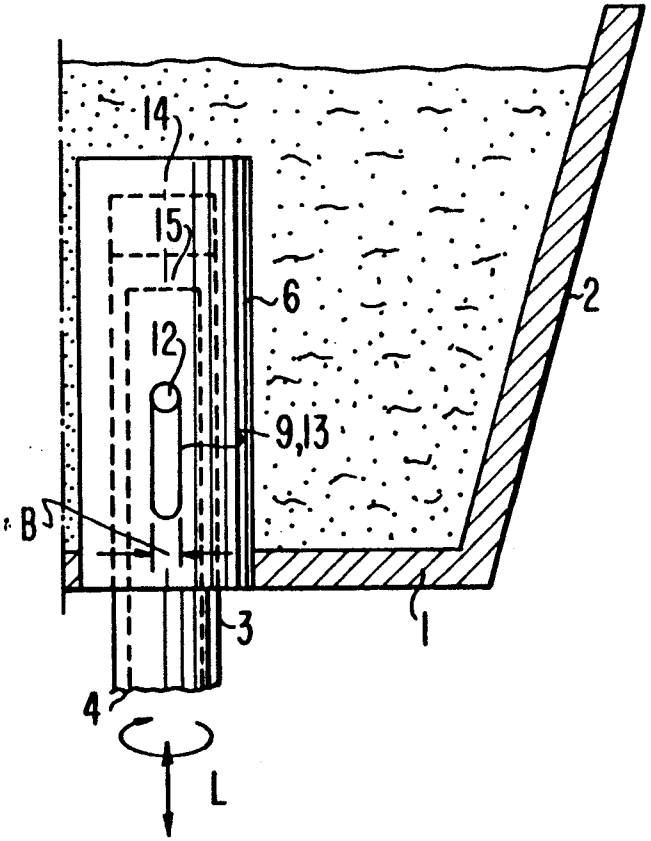
FIG. 4 is a partial view similar to FIG. 1 of a further embodiment of the present invention.
Figure 5:
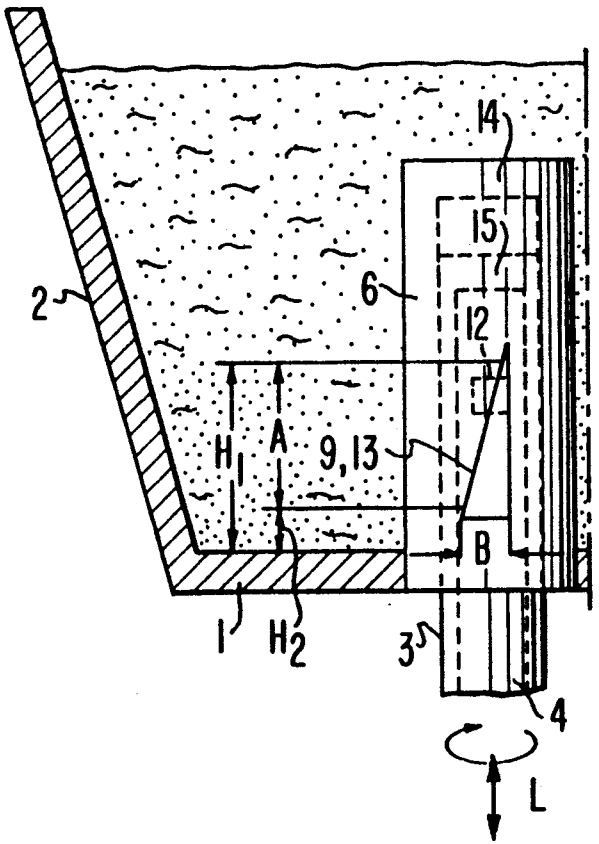
FIG. 5 is a view similar to FIG. 4 of a yet further embodiment of the present invention.

The embodiments of FIGS. 4 and 5 are similar to the embodiments of FIGS. 2 and 3, respectively, with the exception that the relative positions of the stationary and displaceable pipes are reversed. Thus, in the embodiments of FIGS. 4 and 5, the outer pipe 6 is stationarily fixed within the bottom 1 of the metallurgical vessel 2. Inner pipe 3 fits within outer pipe 6 and is movable longitudinally and rotatably relative thereto. Particularly, inner pipe 3 can be operated in a known manner from below the bottom of the vessel. Outer pipe 6 is closed at its upper end 14 at a level below the level of the molten metal in vessel 2. Inner pipe 3 is closed at upper end 15, but can be open or have openings therein. The slots 13 still are formed in the stationary pipe, in this case the outer pipe 6. Opening or openings 12 still are formed in the movable pipe, in this case inner pipe 3. It is to be understood that the stationary outer pipe 6 also could be provided with a plurality of openings such as openings 10, 11 discussed above with regard to the embodiment of FIG. 1.

The embodiments of FIGS. 4 and 5 operate in the same manner as discussed above regarding the embodiments of FIGS. 2 and 3, with the exception that it is the inner pipe 3 that is displaced throughout the working stroke A to regulate the discharge height and the ferrostatic pressure.

Although the present invention has been described and illustrated with respect to preferred embodiments thereof, it is to be understood that various changes and modifications may be made to the specifically described and illustrated features without departing from the scope of the present invention.

We claim:

1. A closing or regulating apparatus for tapping molten metal from the interior of a metallurgical vessel, said apparatus comprising:

a vertical inner pipe having extending through a wall thereof opening means for the passage of molten metal;

an outer pipe fitted over said inner pipe and having extending through a wall thereof opening means for the passage of molten metal;

one of said pipes to be mounted stationary with respect to a metallurgical vessel;

the other of said pipes being displaceable relative to said one pipe in a vertical axial direction through a working stroke at which said opening means of said pipes may be brought into alignment to thereby discharge molten metal downwardly through the interior of said inner pipe;

the dimension of said opening means in said stationary pipe in said direction being greater than the dimension of said opening means in said displaceable pipe in said direction;

the circumferential dimension of said opening means in said displaceable pipe being substantially the same as the circumferential dimension of a lower portion of said opening means in said stationary pipe;

at an upper end of said working stroke a lower portion of said opening means in said stationary pipe being closed by said displaceable pipe and an upper portion of said opening means in said stationary pipe being aligned with said opening means in said displaceable pipe;

at a lower end of said working stroke said upper portion of said opening means in said stationary pipe being closed by said displaceable pipe and said lower portion of said opening means in said stationary pipe being aligned with said opening means in said displaceable pipe; and said opening means in said stationary pipe comprising at least two openings spaced in said direction, said openings having the same cross section.

2. An apparatus as claimed in claim 1, wherein said opening means in said displaceable pipe comprises an opening having the same shape and size as one of said openings in said stationary pipe.

3. A closing or regulating apparatus for tapping molten metal from the interior of a metallurgical vessel, said apparatus comprising:

a vertical inner pipe having extending through a wall thereof opening means for the passage of molten metal;

an outer pipe fitted over said inner pipe and having extending through a wall thereof opening means for the passage of molten metal;

one of said pipes to be mounted stationary with respect to a metallurgical vessel;

the other of said pipes being displaceable relative to said one pipe in a vertical axial direction through a working stroke at which said opening means of said pipes may be brought into alignment to thereby discharge molten metal downwardly through the interior of said inner pipe;

the dimension of said opening means in said stationary pipe in said direction being greater than the dimension of said opening means in said displaceable pipe in said direction;

the circumferential dimension of said opening means in said displaceable pipe being substantially the same as the circumferential dimension of a lower portion of said opening means in said stationary pipe;

at an upper end of said working stroke a lower portion of said opening means in said stationary pipe being closed by said displaceable pipe and an upper portion of said opening means in said stationary pipe being aligned with said opening means in said displaceable pipe;

at a lower end of said working stroke said upper portion of said opening means in said stationary pipe being closed by said displaceable pipe and said lower portion of said opening means in said stationary pipe being aligned with said opening means in said displaceable pipe; and said opening means in said stationary pipe comprising at least one slot elongated in said direction.

4. An apparatus as claimed in claim 3, wherein said slot has upper and lower portions having the same circumferential dimension.

5. An apparatus as claimed in claim 4, wherein said opening means in said displaceable pipe has a circumferential dimension at least equal to said circumferential dimension of said slot.

6. An apparatus as claimed in claim 3, wherein said slot has an upper portion of a circumferential dimension less than that of a lower portion of said slot.

7. An apparatus as claimed in claim 6, wherein the circumferential dimension of said slot increases downwardly.

8. An apparatus as claimed in claim 6, wherein said slot is triangular in configuration.

9. An apparatus as claimed in claim 6, wherein said opening means in said displaceable pipe has a circumferential dimension substantially the same as said circumferential dimension of said lower portion of said slot.

10. A closing or regulating apparatus for tapping molten metal from the interior of a metallurgical vessel, said apparatus comprising:

a vertical inner pipe having extending through a wall thereof opening means for the passage of molten metal;

an outer pipe fitted over said inner pipe and having extending through a wall thereof opening means for the passage of molten metal;

one of said pipes to be mounted stationary with respect to a metallurgical vessel;

the other of said pipes being displaceable relative to said one pipe in a vertical axial direction through a working stroke at which said opening means of said pipes may be brought into alignment to thereby discharge molten metal downwardly through the interior of said inner pipe;

the dimension of said opening means in said stationary pipe in said direction being greater than the dimension of said opening means in said displaceable pipe in said direction;

the circumferential dimension of said opening means in said displaceable pipe being substantially the same as the circumferentially dimension of a lower portion of said opening means in said stationary pipe;

at an upper end of said working stroke a lower portion of said opening means in said stationary pipe being closed by said displaceable pipe and an upper portion of said opening means in said stationary pipe being aligned with said opening means in said displaceable pipe;

at a lower end of said working stroke said upper portion of said opening means in said stationary pipe being closed by said displaceable pipe and said lower portion of said opening means in said stationary pipe being aligned with said opening means in said displaceable pipe; and said opening means in said stationary pipe comprising at least two groups of openings spaced in said direction, the openings of each of said group being spaced circumferentially of said stationary pipe.

11. An apparatus as claimed in claim 6, wherein said opening means in said displaceable pipe comprises a rectangular opening.

12. An apparatus as claimed in claim 1, wherein said stationary pipe comprises said inner pipe.

13. An apparatus as claimed in claim 1, wherein said displaceable pipe comprises said inner pipe.

14. In a stationary pipe member for use with an axially movable pipe member to form a closing or regulating apparatus for tapping molten metal from the interior of a metallurgical vessel, said stationary pipe member being adapted to be stationarily mounted in a vertical orientation with respect to the metallurgical vessel with the axially movable pipe member fitted around or within said stationary pipe member, and said stationary pipe member having therethrough opening means, such that upon axial movement of the movable pipe member relative to said stationary pipe member in a vertical axial direction through a working stroke, said opening means in said stationary pipe member may be in alignment with an opening in the movable pipe member to thereby discharge molten metal downwardly through the interior of the inner pipe, the improvement wherein:

the dimension of said opening means in said stationary pipe member in said axial direction is greater than the dimension of said opening means in said stationary pipe member in a circumferential thereof; and said opening means in said stationary pipe member comprises at least two groups of openings spaced in said direction, the openings of each of said group being spaced circumferentially of said stationary pipe member.

15. The improvement claimed in claim 14, wherein said openings have the same cross section.

16. In a stationary pipe member for use with an axially movable pipe member to form a closing or regulating apparatus for tapping molten metal from the interior of a metallurgical vessel, said stationary pipe member being adapted to be stationarily mounted in a vertical orientation with respect to the metallurgical vessel with the axially movable pipe member fitted around or within said stationary pipe member, and said stationary pipe member having therethrough opening means, such that upon axial movement of the movable pipe member relative to said stationary pipe member in a vertical axial direction through a working stroke, said opening means of said stationary pipe member may be in alignment with an opening in the movable pipe member, to thereby discharge molten metal downwardly through the interior of the inner pipe, the improvement wherein:

the dimension of said opening means in said stationary pipe member in said axial direction is greater than the dimension of said opening means in said stationary pipe member in a circumferential direction thereof; and said opening means in said stationary pipe member comprises at least one slot elongated in said direction.

17. The improvement claimed in claim 16, wherein said slot has upper and lower portions having the same circumferential dimension.

18. The improvement claimed in claim 16, wherein said slot has an upper portion of a circumferential dimension less than that of a lower portion of said slot.

19. The improvement claimed in claim 18, wherein the circumferential dimension of said slot increases downwardly.

20. The improvement claimed in claim 18, wherein the slot is triangular in configuration.

21. An apparatus as claimed in claim 10, wherein said openings have the same cross section.

22. An apparatus as claimed in claim 10, wherein said opening means in said displaceable pipe comprise at least two openings, each said opening in said displaceable pipe having the same shape and size as said openings of one of said groups of openings in said stationary pipe.

23. In a stationary pipe member for use with an axially movable pipe member to form a closing or regulating apparatus for tapping molten metal from the interior of a metallurgical vessel, said stationary pipe member being adapted to be stationarily mounted in a vertical orientation with respect to the metallurgical vessel with the axially movable pipe member fitted around or within said stationary pipe member, and said stationary pipe member having therethrough opening means, such that upon axial movement of the movable pipe member relative to said stationary pipe member in a vertical axial direction through a working stroke, said opening means of said stationary pipe member may be in alignment with an opening in the movable pipe member, to thereby discharge molten metal downwardly through the interior of the inner pipe, the improvement wherein:

the dimension of said opening means in said stationary pipe member in said axial direction is greater than the dimension of said opening means in said stationary pipe member in a circumferential thereof; and said opening means in said stationary pipe member comprises at least two openings spaced in said direction, said openings having the same cross section.

24. An apparatus as claimed in claim 10, wherein said stationary pipe comprises said inner pipe.

25. An apparatus as claimed in claim 10, wherein said displaceable pipe comprises said inner pipe.

26. An apparatus as claimed in claim 3, wherein said stationary pipe comprises said inner pipe.

27. An apparatus as claimed in claim 3, wherein said displaceable pipe comprises said inner pipe.

* * * * *